United States Patent [19]

Tohzuka et al.

[11] Patent Number: 4,985,161

[45] Date of Patent: Jan. 15, 1991

[54] FLUORINE-CONTAINING GREASE AND ITS PREPARATION

[75] Inventors: Takashi Tohzuka; Yoshiaki Kataoka, both of Osaka; Sueyoshi Ishikawa, Kishiwada; Koji Fujiwara, Toyonaka, all of Japan

[73] Assignee: Daikin Industries Ltd., Osaka, Japan

[21] Appl. No.: 525,303

[22] Filed: May 17, 1990

Related U.S. Application Data

[63] Continuation of Ser. No. 347,015, May 4, 1989, abandoned.

[30] Foreign Application Priority Data

May 6, 1988 [JP] Japan ..... 63-110979
May 11, 1988 [JP] Japan ..... 63-115414

[51] Int. Cl.[5] ..... C10M 107/38

[52] U.S. Cl. ..... 252/54; 252/58

[58] Field of Search ..... 252/54, 58

[56] References Cited

U.S. PATENT DOCUMENTS 3,505,229 4/1970 Skehan ..... 252/54
4,472,290 9/1984 Caporiccio et al. ..... 252/58

*Primary Examiner*—Jacqueline V. Howard
*Attorney, Agent, or Firm*—Birch, Stewart, Kolasch & Birch

[57] ABSTRACT

A fluorine-containing grease comprising polytetrafluoroethylene and a perfluoroalkyl polyether which is prepared by polymerizing tetrafluoroethylene in the perfluoroalkyl polyether has good homogeneity and lubricity.

9 Claims, No Drawings

FLUORINE-CONTAINING GREASE AND ITS PREPARATION

This application is a continuation of application Ser. No. 07/347,015, filed on May 4, 1989, now abandoned.

BACKGROUND OF THE INVENTION

1. Field of the Invention

The present invention relates to fluorine-containing grease and its preparation.

2. Description of the Related Art

Fluorine-containing grease can be prepared by mixing a fluorine-containing oil with low molecular weight polytetrafluoroethylene (PTFE) powder. However, this fluorine-containing grease has poor homogeneity.

Also, the fluorine-containing grease can be prepared by mixing the fluorine-containing oil with a dispersion comprising low molecular weight PTFE and a solvent and then removing the solvent. However, the dispersion has poor storage stability.

SUMMARY OF THE INVENTION

An object of the present invention is to provide a fluorine-containing grease having good homogeneity and storage stability. The grease was not prepared by using a dispersion comprising low molecular weight polytetrafluoroethylene and a solvent, which would have resulted in a grease having poor homogeneity and poor storage stability.

Another object of the present invention is to provide a fluorine-containing grease comprising a perfluoroalkyl polyether and polytetrafluoroethylene having good homogeneity and storage stability, which is prepared by polymerizing tetrafluoroethylene in said perfluoroalkyl polyether.

Further, another object of the present invention is to provide a method for preparating a fluorine-containing grease having good homogeneity and storage stability, which method comprises polymerizing tetrafluoroethylene in perfluoroalkyl polyether.

Other objects will appear heinafter.

DETAILED DESCRIPTION OF THE INVENTION

The perfluoroalkyl polyether and polytetrafluoroethylene are used usually in a weight ratio of 50:50 to 90:10, preferably 60:40 to 80:20.

The perfluoroalkyl polyether contains at least one repeating unit selected from the group consisting of a repeating unit of the formula:

$$-C_3F_6O- \quad (a)$$

a repeating unit of the formula:

$$-C_2F_4O- \quad (b)$$

and a repeating unit of the formula:

$$-CF_2O- \quad (c)$$

provided that at least one of the repeating units (a) and (b) is contained and the total number of the repeating units (a), (b) and (c) is at least three. The repeating unit: $-C_3F_6O-$ includes $-CF_2CF_2CF_2O-$ and $-CF(CF_3)CF_2O-$. The repeating unit: $-C_2F_4O-$ is usually $-CF_2CF_2O-$.

Specific Examples of the perfluoroalkyl polyether are $$F(CF_2CF_2CF_2O)_nCF_2CF_3 \quad (1)$$

wherein n is 3 to 200, $$F[CF(CF_3)CF_2O]_nCF_2CF_3 \quad (2)$$

wherein n is 3 to 200, $$CF_3O(CF_2CF_2O)_m(CF_2O)_nCF_3 \quad (3)$$

wherein m is 3 to 100 and n is 3 to 150, and $$CF_3O[CF(CF_3)CF_2O]_m(CF_2O)_nCF_3 \quad (4)$$

wherein m is 3 to 100 and n is 1 to 200.

Other examples and preparation of the perfluoroalkyl polyether are described in U.S. Pat. Nos. 3,242,218, 3,715,378, 4,845,268 and 3,665,041 the disclosures of which are incorporated herein by reference.

Polytetrafluoroethylene can be prepared by polymerizing tetrafluoroethylene in perfluoroalkyl polyether. Polytetrafluoroethylene usually has a molecular weight of 5,000 to 500,000, preferably 10,000 to 100,000.

In addition to the perfluoroalkyl polyether, a fluorine-containing solvent is preferably used during polymerization of tetrafluoroethylene. The fluorine-containing solvent used is a solvent which is compatible with the perfluoroalkyl polyether and is, for example, trichlorotrifluoroethane, 1,2,4,4-tetrachloro-1,1,2,3,3,4-hexafluorobutane, 1,2,4-trichloro-1,1,2,3,3,4,4-heptafluorobutane, perfluorotributylamine, a perfluoroalkyl polyether which has a boiling point of not higher than 260° C. [e.g. $F(CF_2CF_2CF_2O)_nCF_2CF_3$ ($2 \leqq n \leqq 5$)], perfluorobenzene or $C_{5-15}$ perfluoroalkane, particularly perfluorooctane. The fluorine-containing solvent is used in an amount of 0.5 to 10 parts by weight per one part by weight of the perfluoroalkyl polyether.

A polymerization initiator is preferably used to initiate the polymerization of tetrafluoroethylene. The polymerization initiator is preferably a peroxide having the decomposition temperature of −20° to 200° C. Specific examples of the peroxide are di-t-butyl peroxide, dibenzoyl peroxide and diisopropyl peroxide. Also, azo compounds such as azobisisobutyronitrile can be used. The amount of the polymerization initiator is not critical, but usually 0.1 to 1% by mole based on the tetrafluoroethylene.

The polymerization is usually carried out at 20° to 200° C. for 1 to 24 hours. During polymerization, tetrafluoroethylene can be supplied by bubbling a tetrafluoroethylene gas in the perfluoroalkyl polyether or flowing the tetrafluoroethylene gas in a gaseous phase of a reactor which contains a perfluoroalkyl polyether liquid phase.

When the fluorine-containing solvent is used, the fluorine-containing grease can be obtained by evaporating the fluorine-containing solvent after polymerization.

The fluorine-containing grease may be used as such or after addition of a perfluoroalkyl polyether, as a grease for various applications. The fluorine-containing grease can have arbitrary consistency by adding the perfluoroalkyl polyether. The fluorine-containing grease usually has the consistency of 200 to 400 according to a penetration method.

The fluorine-containing grease according to the present invention has good homogeneity and lubricity and can reduce noise when used as a lubricant for a bearing. Pores of the fluorine-containing grease can be adjusted by varying, for example, the amount of the fluorine-containing solvent, the viscosity of the perfluoroalkyl polyether and the amount of tetrafluoroethylene.

PREFERRED EMBODIMENTS OF THE INVENTION

The present invention is illustrated by the following Examples.

EXAMPLE 1

In a 200 ml glass autoclave, 1,2,4,4-tetrachloro-1,1,2,3,3,4-hexafluorobutane (Daiflon 316 manufactured by Daikin Industries Ltd) (100 ml) and perfluoroalkyl polyether of the formula:

$$F(CF_2CF_2CF_2O)_nCF_2CF_3$$

wherein n is 30 on the average (25 g) were charged. Then di-t-butyl peroxide (0.04 g) was added and the mixture was heated to 120° C. while vigorously stirring.

A tetrafluoroethylene gas was supplied at 120° C. to keep the pressure at 4 to 5 kg/cm$^2$G. After 10 g of tetrafluoroethylene was supplied, its supply was stopped and the mixture was cooled to a room temperature to complete the reaction. After removing the contents from the autoclave, the solvent, namely Daiflon 316 was evaporated off by means of an evaporator to obtain a fluorine-containing grease. Yield: 32 g.

The fluorine-containing grease had the consistency of 283 according the penetration method. Polytetrafluoroethylene was separated from the perfluoroalkyl polyether by extracting the fluorine-containing grease with trichlorotrifluoroethane. A polytetrafluoroethylene content was 23% by weight. According to a differential scanning calorimetry (DSC), polytetrafluoroethylene had the melting point of 28° C.

EXAMPLE 2

In a one liter glass autoclave, 1,2,4,4-tetrachloro-1,1,2,3,3,4-hexafluorobutane (Daiflon 316 manufactured by Daikin Industries Ltd) (500 ml) and the perfluoroalkyl polyether of the formula:

$$F(CF_2CF_2CF_2O)_nCF_2CF_3$$

wherein n is 25 on the average (120 g) were charged. Then di-t-butyl peroxide (0.18 g) was added and the mixture was heated to 120° C. while vigorously stirring.

A tetrafluoroethylene gas was supplied at 120° C. to keep the pressure at 5 to 6 kg/cm$^2$G. After 60 g of tetrafluoroethylene was supplied, its supply was stopped and the mixture was cooled to a room temperature to complete the reaction. After removing the contents from the autoclave, the solvent, namely Daiflon 316 was evaporated off to obtain a fluorine-containing grease. Yield: 163 g .

The fluorine-containing grease had the consistency of 220 according to the penetration method. A polytetrafluoroethylene content was 30% by weight. According to the differential scanning calorimetry (DSC), polytetrafluoroethylene has the melting point of 327° C.

EXAMPLE 3

In a 200 ml glass autoclave, the perfluoroalkyl polyether of the formula:

$$F(CF_2CF_2CF_2O)_nCF_2CF_3$$

wherein n is 30 on the average (100 ml) was charged. Then di-t-butyl peroxide (0.04 g) was added and the mixture was heated to 120° C. while vigorously stirring.

A tetrafluoroethylene gas was supplied at 120° C. to keep the pressure at 5 to 6 kg/cm$^2$G. After 70 g of tetrafluoroethylene was supplied, its supply was stopped. The mixture was cooled to a room temperature and the reaction was completed to obtain a fluorine-containing grease. Yield: 233 g.

The fluorine-containing grease had the consistency of 279 according the penetration method. A polytetrafluoroethylene content was 21% by weight.

EXAMPLE 4

The fluorine-containing grease (Grease 1) prepared in Example 1 according to the present invention, a conventional grease (Grease 2) (Demnum Grease L-100 manufactured by Daikin Industries Ltd.) which is prepared by mixing low molecular weight polytetrafluoroethylene powder with a fluorine-containing oil, a conventional grease (Grease 3) (KRYTOX 240 AC manufactured by Du pont) which is prepared by mixing a dispersion of low molecular weight polytetrafluoroethylene with a fluorine-containing oil and removing a solvent and the fluorine-containing grease (Grease 4) prepared in Example 3 according to the present invention, were subjected to the following test.

A glass plate having the thickness of 1 mm was coated with the grease and degassed, and another glass plate having the same thickness was placed on the former plate while preventing air bubbles in the grease layer. The thickness of the grease layer was adjusted to 150 μm. By using a direct-reading hazeometer (manufactured by Toyo Seiki Seisakusyo, Japan, according to JIS K 6714 and K 6717 and ASTM D 1003), a total light transmittance $T_t$, a diffuse transmittance $T_d$ and a haze value H were measured. The results are shown in Table.

The total light transmittance ($T_t$) indicates a ratio of the transmitted light to the incident light and is measured by collecting the light transmitted through the sample by means of an integrating sphere, an inner surface of which is treated with MgO (magnesium oxide, almost ideal white color) and a standard plate treated with the same MgO.

The diffuse transmittance ($T_d$) indicates a ratio of the transmitted and diffused light to the incident light and is measured by absorbing the straightforward light and collecting only the diffused light by means of the integrating sphere among the transmitted light.

The haze value (H) indicates a ratio of the transmitted and diffused light to the transmitted light and a degree of haze when seeing an object through the sample. The higher the haze value is, the more hazily the object is seen.

TABLE

| | $T_t$ (%) | $T_d$ (%) | H (%) |
|---|---|---|---|
| Grease 1 | 80.0 | 38.7 | 48.5 |
| Grease 2 | 52.8 | 44.3 | 85.7 |
| Grease 3 | 78.2 | 46.1 | 59.1 |
| Grease 4 | 79.5 | 39.9 | 49.7 |
| Blank | 85.0 | 0.7 | 0.9 |

TABLE-continued

| | $T_t$ (%) | $T_d$ (%) | H (%) |
|---|---|---|---|
| (only glass plates) | | | |

As apparent from the results of the above Table, the grease according to the present invention has a large total transmittance and a small diffuse transmittance and thus high transparency. The high transparency means that, in the grease according to the present invention, a thickening agent, namely polytetrafluoroethylene is highly homogeneously dispersed in a base oil.

What is claimed is:

1. A fluorine-containing grease comprising a perfluoroalkyl polyether and polytetrafluoroethylene, wherein the perfluoroalkyl polyether and polytetrafluoroethylene are used in a weight ratio of 50:50 to 90:10 and which is prepared by polymering tetrafluoroethylene in the presence of said perfluoroalkyl polyether.

2. The grease according to claim 1, wherein said tetrafluoroethylene is polymerized in a solution comprising the perfluoroalkyl polyether and a fluorine-containing solvent.

3. The grease according to claim 1, wherein the perfluoroalkyl polyether contains at least one repeating unit selected from the group consisting of a repeating unit of the formula:

$$-C_3F_6O- \quad (a)$$

a repeating unit of the formula:

$$-C_2F_4O- \quad (b)$$

and a repeating unit of the formula:

$$-CF_2O- \quad (c)$$

provided that at least one of the repeating units (a) and (b) is contained and total number of the repeating units (a), (b) and (c) is 3 to 300.

4. The grease according to claim 1, wherein the perfluoroalkyl polyether is expressed by the formula:

$$F(C_3F_6O)_nCF_2CF_3$$

wherein n is 3 to 200.

5. The grease according to claim 1, wherein the perfluoroalkyl polyether is expressed by the formula:

$$CF_3O(C_3F_6O)_m(CF_2O)_nCF_3$$

wherein m is 3 to 100 and n is 3 to 150.

6. The grease according to claim 1, wherein the polytetrafluoroethylene has a molecular weight of 5,000 to 500,000.

7. The grease according to claim 1, wherein the perflouroalkyl polyether and polytetrafluoroethylene are used in a weight ratio of 60:40 to 80:20.

8. A method for preparing a fluorine-containing grease comprising polytetrafluoroethylene and a perfluoroalkyl polyether, wherein the perfluoroalkyl polyether and polytetrafluoroethylene are used in a weight ratio of 50:50 to 90:10, which method comprises polymerizing tetrafluoroethylene in the presence of said perfluoroalkyl polyether.

9. The method according to claim 8, wherein said tetrafluoroethylene is polymerized in a solution comprising the perfluoroalkyl polyether and a fluorine-containing solvent and then the fluorine-containing solvent is removed.

* * * * *